United States Patent [19]

Saito et al.

[11] 4,075,294

[45] Feb. 21, 1978

[54] CARBURETOR ACCELERATING FUEL CIRCUIT MEANS

[76] Inventors: Masaaki Saito, No. 5-25-11, Iwato, Yokosuka; Kenji Okamura, No. 3-5-20, Nakahara, Isogo, Yokohama, both of Japan

[21] Appl. No.: 773,350

[22] Filed: Mar. 1, 1977

[30] Foreign Application Priority Data

Mar. 19, 1976 Japan ..... 51-30581

[51] Int. Cl.[2] ..... F02M 7/08

[52] U.S. Cl. ..... 261/34 A; 138/45; 138/46

[58] Field of Search ..... 261/34 A; 34 B; 138/45, 138/46

[56] References Cited

U.S. PATENT DOCUMENTS

| | | | |
|---|---|---|---|
| 1,873,919 | 8/1932 | Ball et al. | 261/34 A |
| 2,111,399 | 3/1938 | Kommer | 261/34 A |
| 2,621,909 | 12/1952 | Stearns | 138/45 |
| 2,649,290 | 8/1953 | Griffon | 261/34 A |
| 3,105,477 | 10/1963 | Lowther | 138/45 |
| 3,432,152 | 3/1969 | Sweeney | 261/34 A |
| 3,918,481 | 11/1975 | Doe et al. | 138/45 |

FOREIGN PATENT DOCUMENTS

| | | | |
|---|---|---|---|
| A74,260 | 11/1960 | France | 138/45 |

*Primary Examiner*—Tim R. Miles

[57] ABSTRACT

A carburetor is provided with a flow control valve in a fuel discharge passageway leading from an acceleration pump to an air induction passage. The valve is pressure responsive and reduces effective cross sectional area of the passageway in response to pressure in the passageway, the pump discharge pressure.

6 Claims, 5 Drawing Figures

CARBURETOR ACCELERATING FUEL CIRCUIT MEANS

BACKGROUND OF THE INVENTION

The present invention relates to a carburetor for an internal combustion engine, and more particularly to such a carburetor which can control fuel, in quantity, fed to the engine in accordance with accelerating conditions.

Usually carburetors are desired to be provided with a fuel enrichment device, such as an acceleration pump, to meet acceleration demands. The acceleration pump is usually operatively connected with and controlled by a carburetor throttle valve in such a manner that upon acceleration, the quantity of fuel fed by the pump to the engine is controlled in response to "throttle opening degree difference," that is; a difference, in opening degree of a carburetor throttle valve, between initial position of the throttle valve before acceleration and final position of the throttle valve after such acceleration.

If such an acceleration pump is set so as to feed enough quantity of fuel to the engine required upon acceleration with small throttle opening degree difference at low speeds, an overabundance of fuel will be fed to the engine upon acceleration with large throttle opening degree difference at high speeds increasing HC and CO emissions, and thus fuel consumption upon this acceleration becomes great. While, if the pump is set so as to feed enough quantity of fuel to the engine required upon acceleration with large throttle opening degree difference at high speeds, quantity of fuel fed by the pump to the engine upon acceleration with small throttle opening degree difference at low speeds will be small and not enough for the acceleration demand thus degrading driveability.

SUMMARY OF THE INVENTION

The present invention contemplates to modify a carburetor so that it can eliminate unnecessary fuel consumption upon acceleration with large throttle opening degree difference at high speeds.

It is therefore an object of the present invention to provide a carburetor for an internal combustion engine which can feed optimum quantity of fuel to the engine in accordance with various accelerating conditions.

It is another object of the present invention to provide a carburetor as mentioned above which needs little modification of the conventional carburetor previously described.

According to the present invention, there is provided a flow control valve in a fuel discharge passageway leading from a fuel enrichment device of a carburetor to an air induction passage of the carburetor. The flow control valve controls effective cross sectional area of the passageway in response to pressure in the passageway so that optimum quantity of fuel is fed to the engine upon acceleration conditions.

BRIEF DESCRIPTION OF THE DRAWINGS

The invention will be further described hereinafter in connection with the accompanying drawings, in which.

DESCRIPTION OF THE INVENTION

Figure 1:
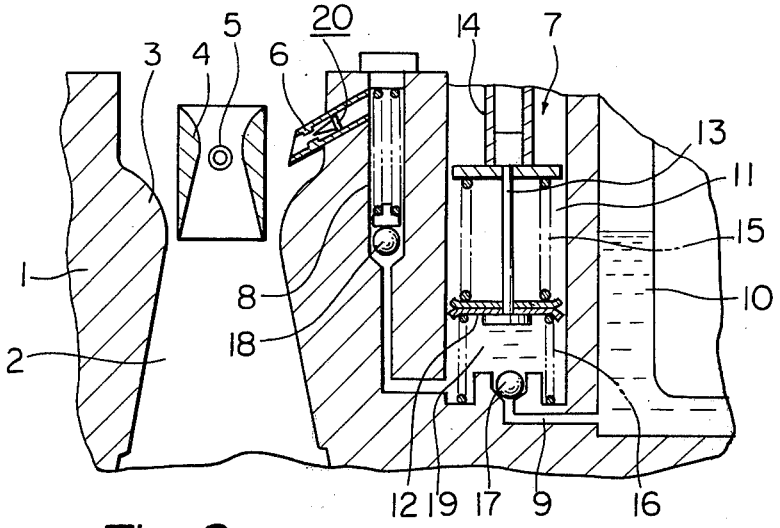
FIG. 1 is a diagrammatic view showing a first embodiment of a carburetor according to the invention.
Figure 2:
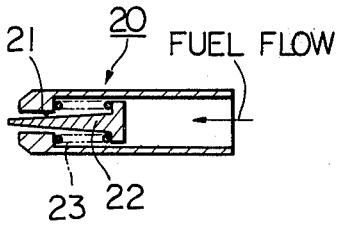
FIG. 2 is a view showing a flow control valve used in the carburetor shown in FIG. 1.

FIG. 1 shows an accelerating fuel supply circuit of a carburetor in which a carburetor main body 1 has an air induction passage 2 formed with a venturi 3, a small or booster venturi 4 positioned within the venturi 3 and a fuel nozzle 5 opening to the booster venturi 4.

An accelerating nozzle 6 has its one end opening to the venturi 3 at upstream thereof and its opposite end connected with an acceleration fuel supply pump 7 through a passage 8. The pump 7 has its inlet side connected to a passage 9 which in turn is connected to a float chamber 10. The pump 7 has a cylinder 11 having a piston 12 slidable therein. The piston 12 is connected through a rod 13 to a plunger 14 which is operatively connected to a throttle valve, not shown, of the carburetor through a like mechanism, such as a pump lever, also not shown. The rod 13 is fixed to the piston 12 but slidably received in a hollow of the plunger 14, as shown in FIG. 1. Denoted by 15 is a damper spring disposed between the hub of the plunger 14 and the piston 12. Denoted by 16 is a return spring.

There is provided in the fuel suck-in passage 9 an inlet valve 17 in the form of a ball valve, while an outlet valve 18 is provided in the fuel discharge passage 8. During fuel discharge stroke, the plunger 14 is moved downwardly to compress the damper spring 15 moving the piston 12 downwardly, as viewed in FIG. 1, discharging the fuel in a pump chamber 19 into the discharge passage 8 via the outlet valve 18. Under this condition because of pressure rise within the chamber 19 the inlet valve 17 closes the passage 9 and the outlet valve 18 opens the passage 8. During fuel suck-in stroke the piston 12 is lifted to the illustrated position shown in FIG. 1 by the rod 13 as the plunger 14 is moved upwardly. Under this condition the inlet valve 17 opens the passage 9 and the outlet valve 18 closes the passage 8.

A flow control valve 20 is disposed in the acceleration nozzle 6 to optimize quantity of fuel therethrough by reducing the effective cross sectional area of the nozzle 6 in response to the pump discharge pressure.

The flow control valve 20 may take any one of the forms shown in FIGS. 2 through 5.

An example of a flow control valve 20 shown in FIG. 1 comprises a valve opening 21, a taper shaped valve member 22 positioned with its tapered end portion extending through the valve opening 21, and a spring 23 biasing the valve member 22 toward the position at which the effective cross sectional area of the valve opening 21 is maximum. The valve member 22 has an area exposed to the pump discharge pressure. As the pump discharge pressure rises the force applied to the area of the valve member 22 by the pump discharge pressure moves the taper shaped valve member 22 into the valve opening 21 against the force of spring 23 reducing the effective cross sectional area of the accelerating nozzle 6.

Figure 3:
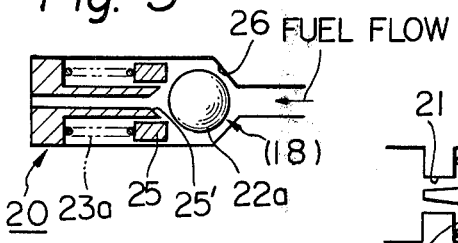
FIG. 3 is a second example of a flow control valve.

FIG. 3 shows the combined form of a flow control valve 20 with an outlet valve 18. A valve seat 25 is resiliently held around a valve opening 25' by means of a spring **23*a*. Provided opposite to the valve seat 25 is a valve seat 26 for preventing reverse flow of fuel. A ball valve 22*a* is movably disposed between and engageable both of the valve seats 25 and 26. As the pump pressure rises, the ball valve member 22*a* engages and urges the valve seat 25 against the action of the spring 23*a*** toward the valve opening to reduce the effective cross sectional area of the same.

Figure 4:
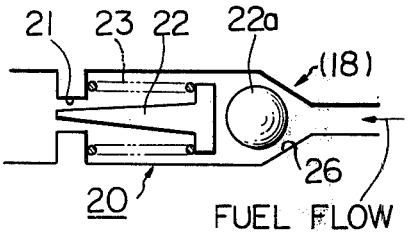
FIG. 4 is a third example of a flow control valve.

FIG. 4 shows the compound form of a flow control valve 20 with an outlet valve 18 also. This form is different from the form shown in FIG. 2 in that a ball valve member 22*a* engageable with a valve seat 26 for preventing the reverse flow is disposed upstream of a valve member 22 of the flow control valve 20.

Figure 5:
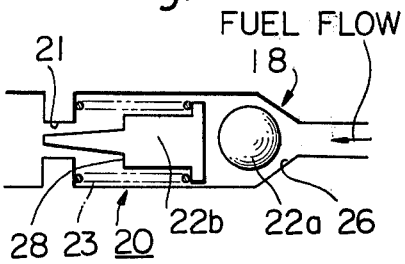
FIG. 5 is a fourth example of a flow control valve.

The form shown in FIG. 5 is different from the form shown in FIG. 4 in that the taper shaped valve member 22*b* of a flow control valve 20 has a shoulder 28 engageable with the valve opening 21. When the pump pressure is abnormally high the shoulder 28 completely closes the valve opening 21.

Because of the provision of the flow control valve 20 when the throttle opening degree difference is relatively small, that is; when the pump discharge pressure is small, the spring 23 will maintain the valve member 22 in a position to fully open the valve opening thereby securing an optimum amount of fuel. When the acceleration is very rapid and the throttle opening degree difference is large, that is; when the pump discharge pressure is large, the valve member 22 is urged against the action of the spring 23 toward the valve opening 21 to reduce the effective cross sectional area thereby preventing oversupply of the fuel.

It will now be understood that the provision of the flow control valve will always optimize the amount of fuel supply during acceleration.

The same result can be obtained wherever the flow control valve 20 is disposed as far as at a position on the downstream of or discharge side of the accelerating pump.

When, in operation, the piston 12 is urged downwardly (as viewed in FIG. 1) by throttle valve through the plunger 14 and the damper spring 15, the fuel in the pump chamber 19 is pushed out of the pump chamber due to the pressure rise of the fuel in the pump chamber 19 and opens the outlet valve 18 and then flows through the flow control valve 20 into the air induction passage 2. When the piston 12 is lifted to return to its initial raised position in response to closing movement of the throttle valve the inlet valve 17 opens to permit fuel to flow from the float chamber 10 to the pump chamber 19.

In the case of the compound forms shown in FIGS. 3–5, the ball valve member 22a will seat on the valve seat 26 for preventing the reverse fuel flow when the piston performs the suck-in stroke.

As will now be understood from the preceding, according to the present invention, the fuel supply for accelerating condition will be optimized. Therefore, enough amount of fuel for acceleration can be secured even during relatively slow acceleration from low speed operation thus contributing smooth operation during transition operating period from the slow fuel circuit operation to main fuel circuit operation. In addition, oversupply of fuel will be prevented upon rapid acceleration.

The shape of the valve opening and the cooperating valve member of a flow control valve may be selected in accordance with the desired fuel supply character. The present invention can be applied to a carburetor having a diaphragm actuated acceleration pump.

What is claimed is:

1. A carburetor for an internal combustion engine comprising:

an accelerating fuel circuit means for feeding fuel to an air induction passage upon acceleration conditions through a fuel discharge passageway leading to the air induction passage; and a flow control valve means for reducing effective cross sectional area of said fuel discharge passageway in response to fuel discharge pressure in said fuel discharge passageway.

2. A carburetor as claimed in claim 1, in which said accelerating fuel circuit means comprises:

a chamber in flow communication with a float chamber under the control of an inlet valve and in flow communication with said air induction passage through said fuel discharge passageway under the control of an outlet valve and said flow control valve means; and means for displacing fuel out of said chamber into said fuel discharge passageway upon accelerating conditions.

3. A carburetor as claimed in claim 2, in which said flow control valve means comprises a valve opening disposed in said fuel discharge passageway; a taper shaped valve member positioned with its tapered end portion extending through said valve opening; and a spring means biasing said valve member toward a position at which the effective cross sectional area is maximum, said valve member having an area exposed to fuel discharge pressure in said passageway, the arrangement being such that as the fuel discharge pressure rises, a force applied to said area by the fuel discharge pressure moves said tapered shaped valve member against the bias action of said spring means in a sense to reduce effective cross sectional area of said valve opening.

4. A carburetor as claimed in claim 1, in which said flow control valve means comprises a valve opening disposed in said fuel discharge passageway; a first valve seat; a spring means for resiliently holding said valve seat around said valve opening; a second valve seat; a ball valve movably disposed between said first and second valve seats and being engageable said first and second valve seats, the arrangement being such that as fuel discharge pressure in said passageway rises, said ball valve urges said first valve seat against the action of the spring toward said valve opening in a sense to reduce effective cross sectional area of said valve opening.

5. A carburetor as claimed in claim 3, in which said flow control valve means comprises a valve seat disposed in said discharge passageway and a ball valve member engageable with said valve seat and disposed in said passageway upstream of said taper shaped valve member.

6. A carburetor as claimed in claim 5, in which said taper shaped valve member is formed with a shoulder engageable with said valve opening to close the same, the arrangement being such that when the fuel discharge pressure in said fuel discharge passageway is abnormally high said shoulder closes said valve opening.

* * * * *